US008746160B2

(12) United States Patent
Berwanger et al.

(10) Patent No.: US 8,746,160 B2
(45) Date of Patent: Jun. 10, 2014

(54) PUNCHING DEVICE AS WELL AS THROAT PLATE FOR PUNCHING

(75) Inventors: Rainer Berwanger, Gailingen (DE); Paula Scaffidi, Summerfield, NC (US)

(73) Assignee: BERNINA International AG, Steckborn (CH)

( * ) Notice: Subject to any disclaimer, the term of this patent is extended or adjusted under 35 U.S.C. 154(b) by 590 days.

(21) Appl. No.: 12/986,271

(22) Filed: Jan. 7, 2011

(65) Prior Publication Data

US 2011/0174204 A1 Jul. 21, 2011

(30) Foreign Application Priority Data

Jan. 15, 2010 (CH) ..... 0054/10

(51) Int. Cl.
*D05B 85/00* (2006.01)

(52) U.S. Cl.
USPC ..... 112/222

(58) Field of Classification Search
USPC ..... 112/221, 222, 227, 261, 235, 240, 245, 112/257
See application file for complete search history.

(56) References Cited

U.S. PATENT DOCUMENTS

| | | | | |
|---|---|---|---|---|
| 1,419,718 | A * | 6/1922 | Chertok | 112/261 |
| 1,939,620 | A * | 12/1933 | Ciravolo | 112/261 |
| 4,441,444 | A * | 4/1984 | Jung | 112/311 |
| 4,917,032 | A * | 4/1990 | Matsumoto | 112/475.04 |
| 5,791,273 | A * | 8/1998 | Sakino | 112/261 |
| 5,848,572 | A * | 12/1998 | Ito | 112/199 |
| 6,098,555 | A * | 8/2000 | Sakuma | 112/165 |
| 6,729,251 | B2 * | 5/2004 | Nishikawa et al. | 112/245 |
| 2005/0268831 | A1 | 12/2005 | Chang | |

* cited by examiner

*Primary Examiner* — Tejash Patel
(74) *Attorney, Agent, or Firm* — Volpe and Koenig, P.C.

(57) ABSTRACT

A punching device (1) is fastened at the pressure shaft of a sewing machine, vertically displaceable via a carrier (3). The vertical position of the press pad (35) at the body (33) can be adjusted by an adjustment screw (16) to the thickness of the textiles/work pieces to be processed.

10 Claims, 4 Drawing Sheets

PUNCHING DEVICE AS WELL AS THROAT PLATE FOR PUNCHING

CROSS-REFERENCE TO RELATED APPLICATIONS

This application claims the benefit of Swiss Patent Application No. 00054/10, filed Jan. 15, 2010, which is incorporated herein by reference as if fully set forth.

BACKGROUND

The invention is directed to a punching device to be attached to a sewing machine as well as a throat plate for punching.

Punching, also called felting, is understood as the connection of two textile structures using needles, however without any thread. Such devices are known from prior art, e.g., from US 2005/0268831, including such that can be attached to household sewing machines. These devices comprise a press pad mounted to the presser foot shaft, having a number of holes according to the number of punching needles or a slot common for all needles. Such devices cannot be adjusted to the textiles to be processed.

SUMMARY

The objective of the present invention is to provide a device for punching, by which two or more textile materials of arbitrary thicknesses can be matted to each other in a secure fashion. Another object of the present invention is to provide a throat plate, which prevents the felting of materials underneath the throat plate to be connected to each other.

This objective is attained in a punching device as well as by a throat plate according to the features of the invention. Advantageous embodiments of the device are described in the attached claims.

The device according to the invention can easily be adjusted to the thickness of the materials to be processed, which prevents the material to be matted together from accidentally gliding over the press pad, and tape-shaped material to be felted to the base material can be precisely fed. By the adjustable and elastic connection between the support and the body it can be prevented that any damaging collision occurs between the needles and/or the needle holder and the body with the sole, when the pressure foot shaft has not been lowered, if the user moves the needle either manually or via the motor. Accordingly, this fastening of the body with its sole allows it to be pushed downward by an unintentional movement of the needle or the needle holder. The axial extension of the penetrating holes in the throat plate in the axial direction prevents any felting of the work piece underneath the throat plate.

BRIEF DESCRIPTION OF THE DRAWINGS

The invention is explained in greater detail using an illustrated exemplary embodiment. In the drawings.

DETAILED DESCRIPTION OF THE PREFERRED EMBODIMENTS

Figure 1:
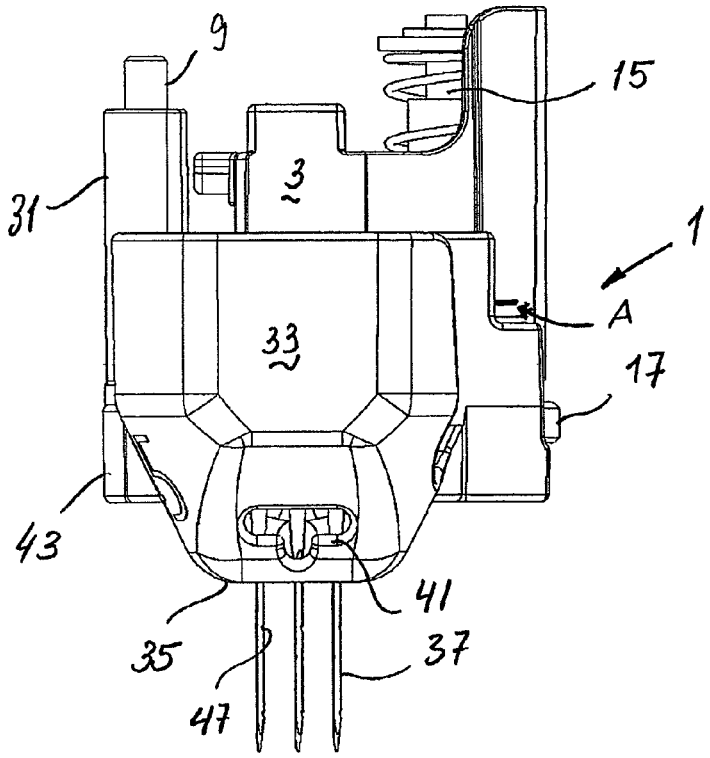
FIG. 1 is a perspective front view of the device.

A punching device, device 1 for short, is marked with the reference character 1. It comprises a carrier 3, in which a vertically extending conical bore 5 is located, by which the device 1 can be mounted at the conical end of a presser foot shaft of a household sewing machine. For reasons of better visibility the presser foot shaft and the sewing machine are not shown. The fastening of the device 1 to the presser foot shaft occurs in a conventional manner via a fastening screw (screw not shown) screwed into a threaded bore 7 of the carrier 1. Further, a hollow-cylindrical housing 11 is formed on the carrier 3, in which an adjustment screw 15 is supported in a rotary fashion. A hand-wheel 17 is formed on the adjustment screw 15 or fastened in a torque-proof manner. The hand-wheel 17 preferably comprises striations on its periphery to increase the grip. Above the hand-wheel 17, a thread 19 is formed on the adjustment screw 15, which engages the internal thread of a sheath 21 held in the housing 11 in a torque-proof fashion. In the area of its lower end, the housing 11 comprises a projection 23 protruding inwardly, with a spring 25 being supported on its shoulder. The second end of the spring 25 is held in the area of the upper end of the adjustment screw 15, for example by an open washer 27, which is axially secured by a safety washer 29.

At the side of the housing 11, a guiding element 31 is formed on the carrier 3, with the guiding rod 9 being supported in a central bore in an axially displaceable fashion.

A cup-shaped body 33, preferably made from a transparent material, is positioned in front of the carrier 15. At its bottom end, said body is shaped like a frustrum or a truncated pyramid and closed at its bottom end by a press pad or sole 35, which forms a presser foot. Either a number of bores equivalent to the number of punching needles 37 or a slot 39 is formed in the sole 35, i.e. the presser foot. Additionally, a T-shaped recess 41 can be inserted, located parallel to the slot 39 and already located in the conical area, in order to feed tapes, cords, string, or braids. Additional recesses may also be provided (not shown.)

Figure 5:
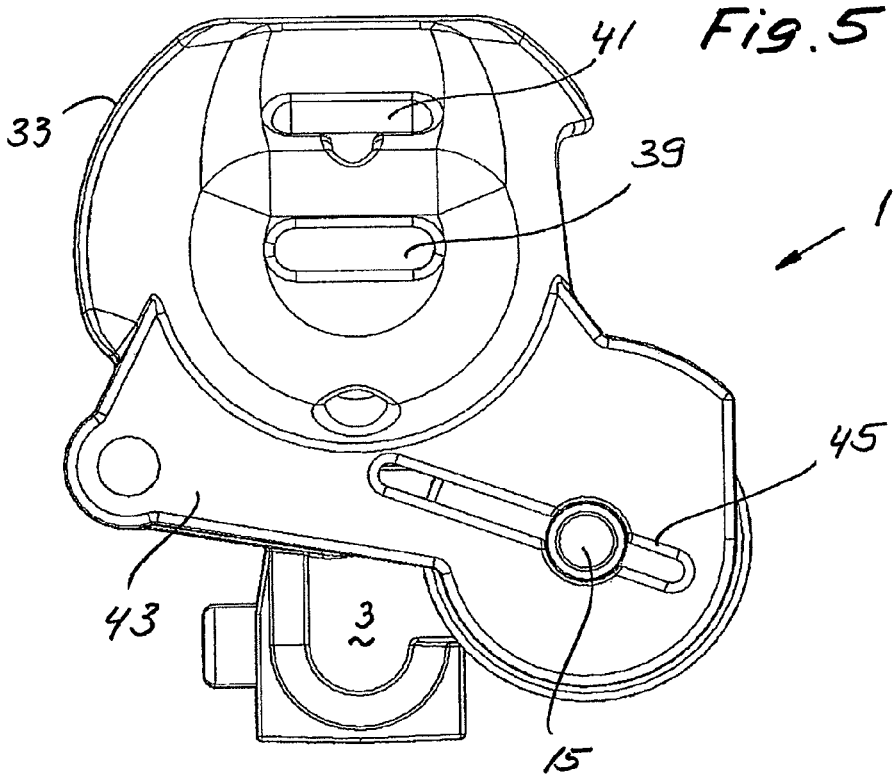
FIG. 5 is a bottom view of the device according to FIG. 1.

The guiding rod 9 is held at its rear end in a catch 43, pointing away from the body 33 towards the rear. The catch 43 is additionally connected to a holder 13, formed on the body 33, and positioned perpendicularly in reference to the adjustment screw 15. The holder serves as a rotational bearing for the adjustment screw 15. In FIG. 5, a slot 45 is discernible in the holder 13, which comprises an annular expansion in the area of the adjustment screw 15 for the rotational fastening of the adjustment 15. Of course, the fastening of the adjustment screw 15 can also occur via a snap ring or another element allowing a rotary motion. The slot 45 allows the fastening of the adjustment screw in the holder 13 without any tools or adhesives.

In the following the functionality of the device 1 is explained.

Figure 2:
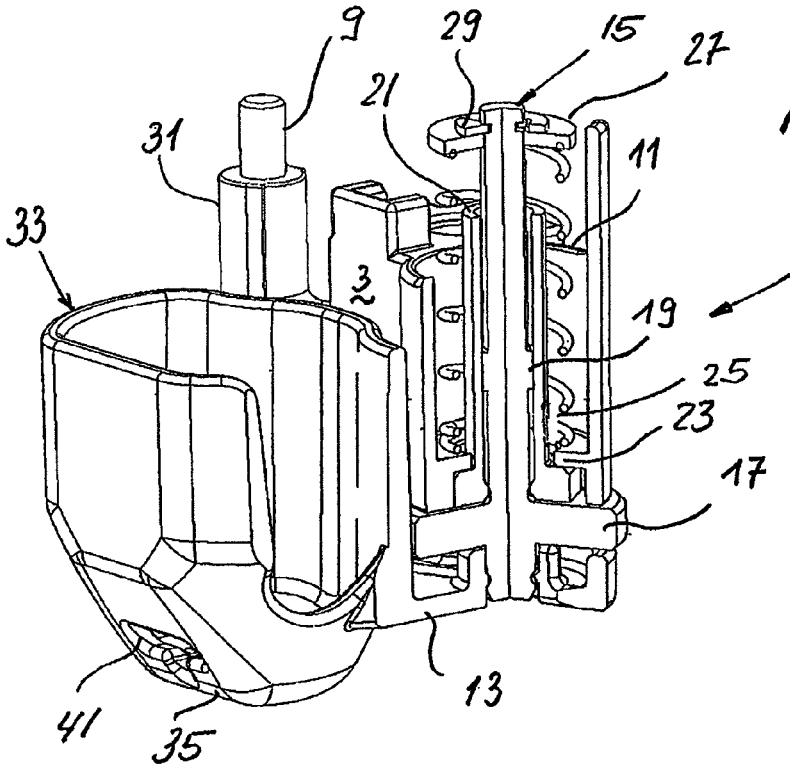
FIG. 2 is a vertical cross-section through the device along the line II-II in FIG. 4, adjusted to thick materials.
Figure 3:
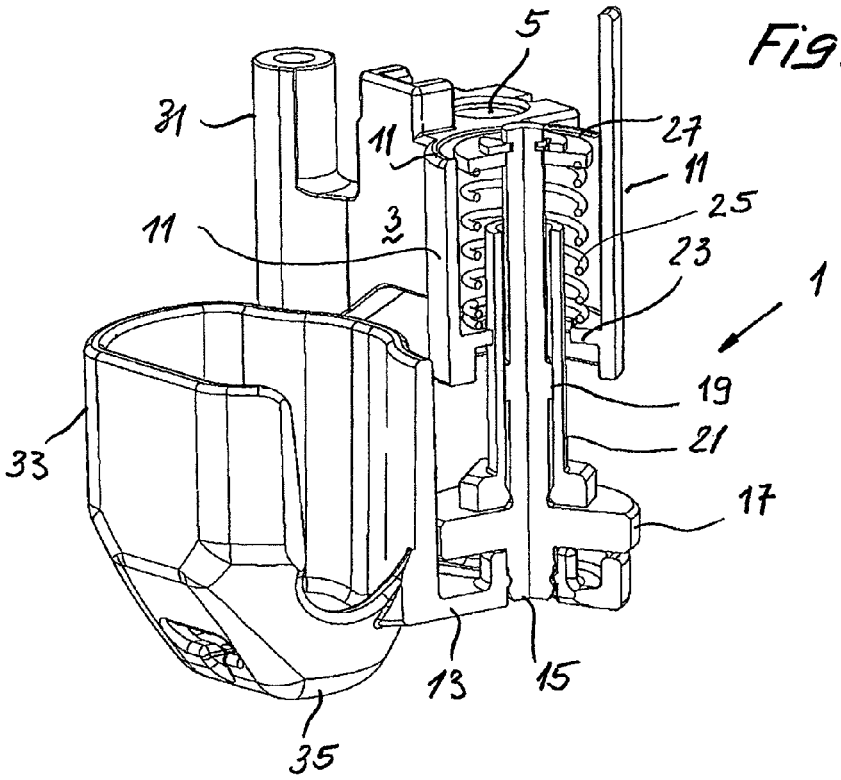
FIG. 3 is a vertical cross-section through the device along the line II-II in FIG. 4, unlatched.
Figure 4:
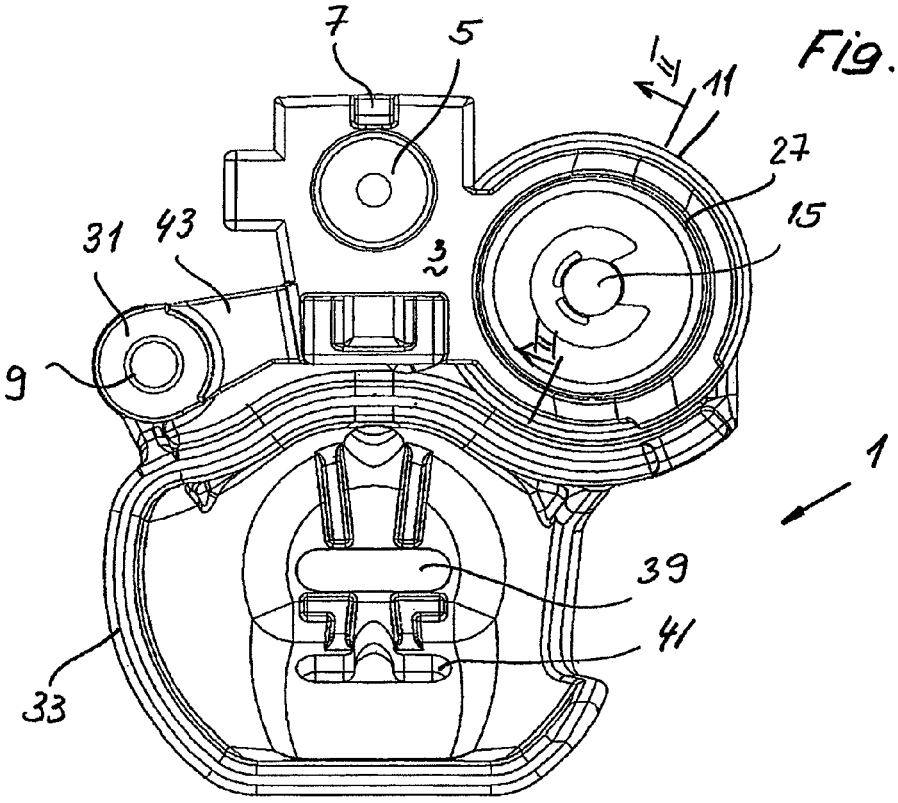
FIG. 4 is a top view of the device according to FIG. 1.
Figure 6:
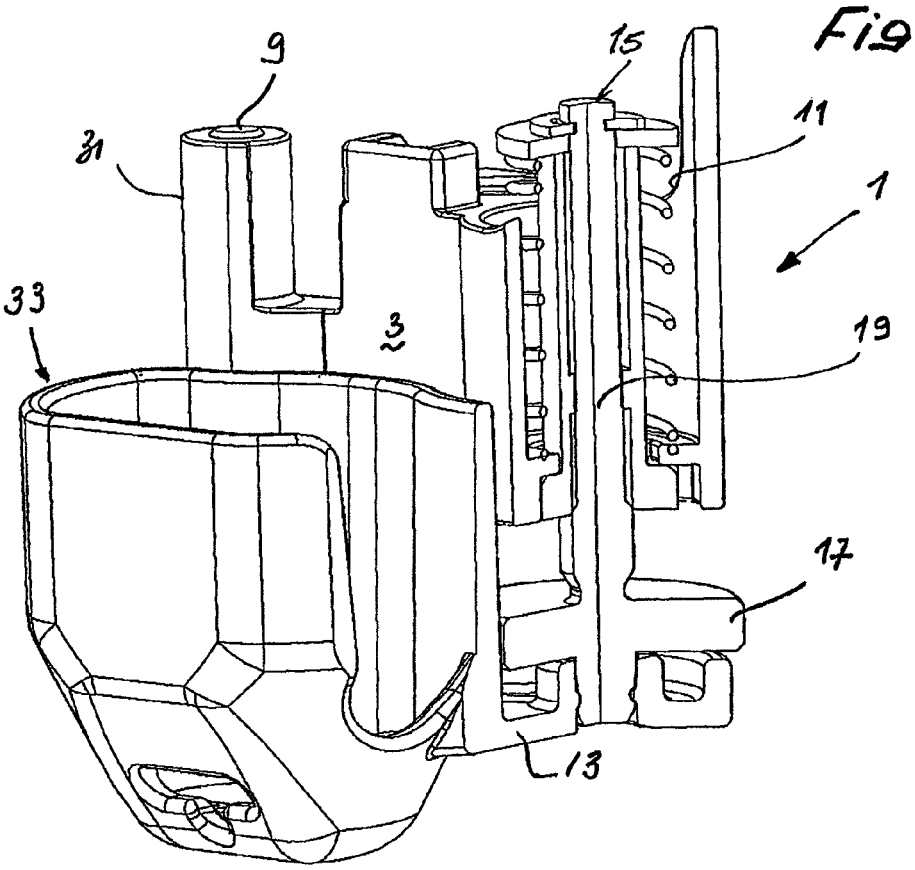
FIG. 6 is a vertical cross-section through the device along the line II-II in FIG. 4.

The device is fastened at the lower end of the pressure shaft like a conventional sewing foot. Additionally the needles 37, with barbs 47 being provided on the shafts thereof, are individually fastened in needle receivers (not shown), that are connected to the lower end of the needle bar of the sewing machine. Subsequently the vertical elevation of the press pad 35 is adjusted according to the thickness of the textiles to be processed via the adjustment wheel 17 (FIG. 2 for thick work pieces, FIG. 6 for thin work pieces). For example, to the elevation "A", as indicated by a line on the right side of FIG. 1. Accordingly, for thin textiles to be processed the body 33 with the press pad 35 is located far down, for example on line D (line D is not visible, because it is covered by the housing 11); for very thick textiles the plate 35 is accordingly moved upwards and held securely against any lifting of the sole 35.

In the event the punching device 1, which is fastened at the pressure shaft, is accidentally lowered downwards onto the work piece before the start of the punching process, the spring 25 prevents the sole 35 and/or the body 33 from causing any collision when the needles 37 are lowered and thus that the sole 35 or the body 33 and/or the needles 37 are destroyed.

Figure 7:
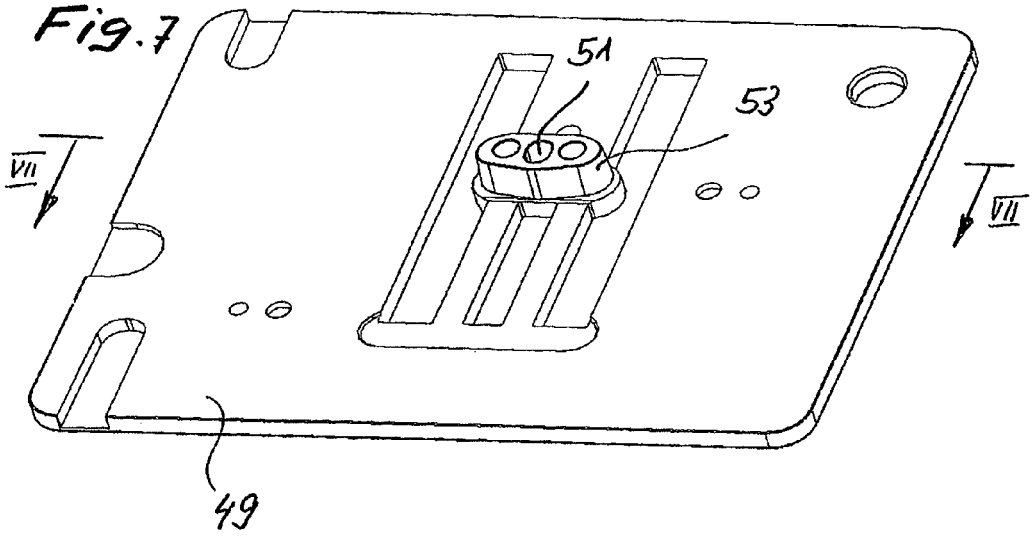
FIG. 7 is a perspective illustration of the throat plate from the bottom.
Figure 8:
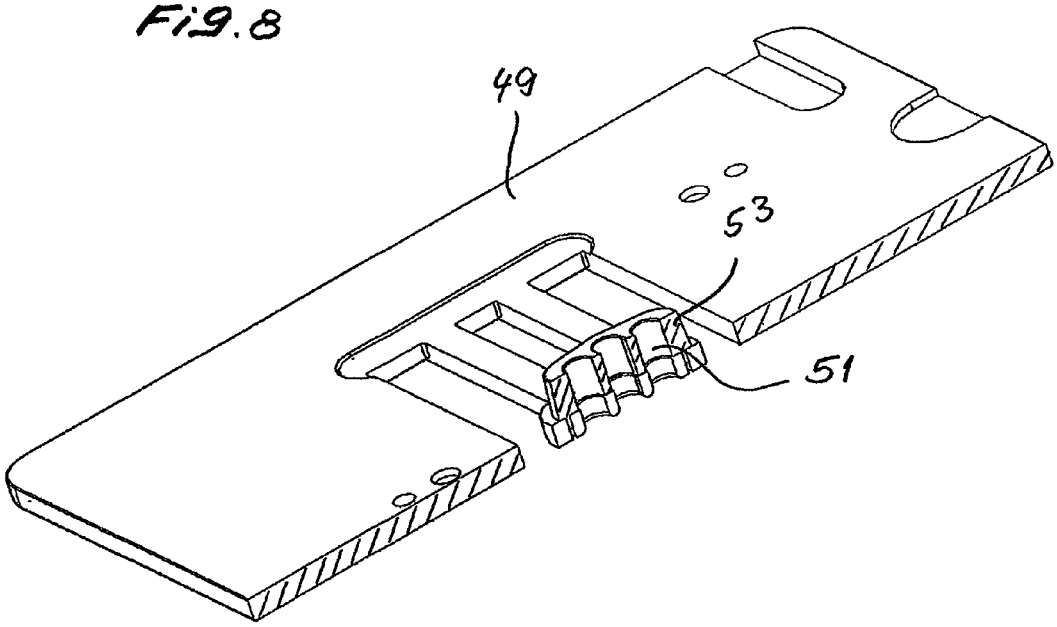
FIG. 8 is a vertical cross-section through the throat plate along the line VII-VII in FIG. 7.

FIGS. 7 and 8, illustrating a throat plate 49, show three penetrating holes 51 for three needles 37. The penetrating holes 51 extend not only over the thickness range of the throat plate 49 but at the bottom of the throat plate 49 a device 53 is placed as an axial extension of the penetrating holes 51. The body of the device 53 may be made from metal or plastic provided with n holes 51, and is fastened at the bottom of the throat plate 49. However, alternatively a tubular body may be fastened under each hole 51. Due to the axial extension of the penetrating holes 51 any felting of the processed material underneath the throat plate 49 can be effectively prevented.

LEGEND

1 Punching device
3 Carrier
5 Bore
7 Threaded bore
9 Guiding rod
11 Housing
13 Fastener
15 Adjustment screw
17 Adjustment wheel
19 Thread
21 Sheath
23 Projection
25 Spring
27 Open washer
29 Snap ring
31 Guiding element
33 Body
35 Sole of 33
37 Needle
39 Slot
41 T-recess
43 Catch
45 Slot
47 Hook
49 Throat plate
51 Penetrating hole
53 Device

The invention claimed is:

1. A punching device (1) that is attachable to a sewing machine, comprising a needle holder for several punching needles (37), a first element that fastens the needle holder with needles (37) to a needle bar of the sewing machine, a press pad with a sole (35) for holding down the work pieces when the needles (37) are retracted, the press pad being arranged such that it can be connected to a pressure shaft of the sewing machine, and a body (33) encompassing the needle (37) as a finger protection, the press pad is formed by the sole (35) of the body (33) that is fastened to a carrier (3), and adjustable via an adjustment screw (15) in an elevation thereof in reference to the carrier (3).

2. The punching device according to claim 1, wherein the carrier (3) is connected to the pressure shaft of the sewing machine in the same manner as a conventional press pad.

3. The punching device according to claim 1, wherein at least one guiding rod (9) is fastened at the press pad with the sole (35), which is supported in a displaceable fashion on the carrier (3) in a guiding bore.

4. The punching device according to claim 3, wherein the adjustment screw (15) is supported on the body in a rotary fashion and an adjustment wheel (17) is mounted in a torque-proof fashion on the adjustment screw (15).

5. The punching device according to claim 4, wherein a pressure spring (25) is inserted between an end of the adjustment screw (15) and the guiding bore.

6. The punching device according to claim 5, wherein a thread (19) is formed on the adjustment screw (15), which extends in a sheath (21) having an internal thread and the sheath (21) penetrates the housing (11) and is encompassed by the pressure spring (25).

7. The punching device according to claim 1, wherein the body is embodied as a transparent finger protection and forms a frustrum or a truncated pyramid, with a cover surface of the frustrum forming the sole (35) and the sole comprising at least one needle hole or needle slot (39).

8. The punching device according to claim 7, wherein a jacket surface of the frustrum comprises recesses (41) for feeding tapes, cords, braids, or thread to be punched.

9. A throat plate (49) for punching for a sewing machine, comprising a top for supporting work pieces and a bottom, comprising at least a number n of needle holes (51) corresponding to a number n of punching needles (37), and a device (53) located at the bottom including openings aligned with and axially extending the needle holes (51) to surround the punching needles below the bottom.

10. The throat plate according to claim 9, wherein the device (53) comprises a body made from metal or plastic and is fastened at the bottom, and a tubular body is arranged underneath each of the needle holes (51).

* * * * *